US005127353A

United States Patent [19]

Wieser

[11] Patent Number: 5,127,353

[45] Date of Patent: Jul. 7, 1992

[54] COMBINED HYDROFOIL AND TROLLING PLATE

[75] Inventor: Michael F. Wieser, Sidney, Nebr.

[73] Assignee: Cabela's Inc., Sidney, Nebr.

[21] Appl. No.: 684,329

[22] Filed: Apr. 12, 1991

[51] Int. Cl.[5] ..... B63H 25/48

[52] U.S. Cl. ..... 114/145 A; 114/280

[58] Field of Search ..... 114/145 A, 145 R, 274, 114/280, 282

[56] References Cited

U.S. PATENT DOCUMENTS

| | | | |
|---|---|---|---|
| 3,965,838 | 6/1976 | Uht | 114/145 A |
| 4,048,940 | 9/1977 | Smith | 114/145 A |
| 4,445,452 | 5/1984 | Loch | 114/282 |
| 4,487,152 | 12/1984 | Larson | 114/274 |
| 4,781,632 | 11/1988 | Litsens et al. | 114/145 A |
| 5,005,507 | 4/1991 | Dyer | 114/280 |

*Primary Examiner*—Jesûs D. Sotelo
*Assistant Examiner*—Stephen P. Avila
*Attorney, Agent, or Firm*—Bachman & LaPointe

[57] ABSTRACT

A combined fixed hydrofoil and trolling plate where the trolling plate is moveable releasably to a horizontal position to enhance the hydrofoil effect of the fixed hydrofoil.

12 Claims, 5 Drawing Sheets

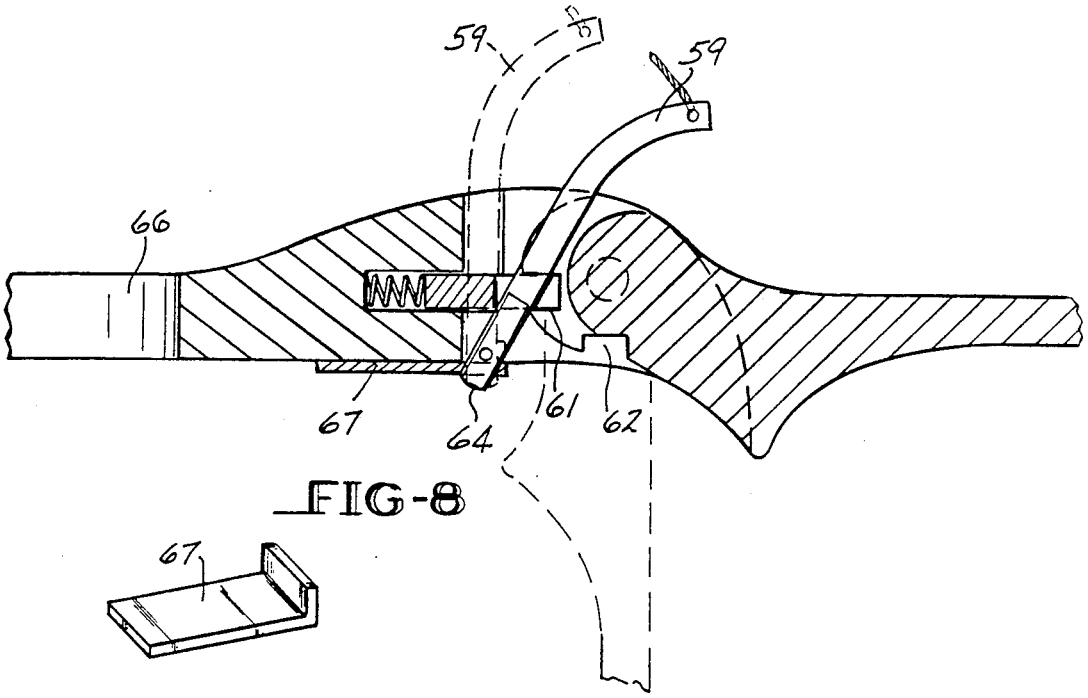
FIG-8
FIG-8A
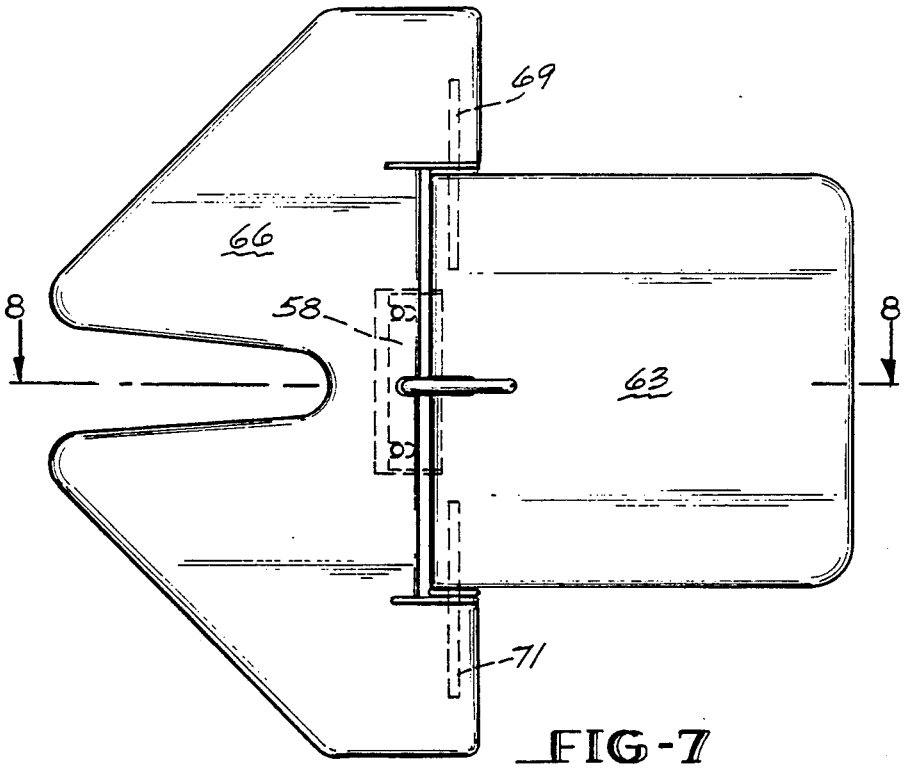
FIG-7

COMBINED HYDROFOIL AND TROLLING PLATE

BACKGROUND OF THE INVENTION

The present invention relates to boats and relates in particular to boats fitted with outboard and inboard/-outboard motors used in recreational and commercial activities.

Boats of the above class are fitted frequently with a trolling plate mounted upon the anti-cavitation plate of the motor housing.

These trolling plates are movable from a generally horizontal position to a vertical position. In the vertical position the plate acts as a baffle astern of the motor propeller to slow motion of the craft through the water during a fishing operation.

The trolling plates usually include releasable latch means for retaining the plates in either position.

Examples of typical prior art trolling plates are disclosed and described in U.S. Pat. Nos. 3,965,838 to UHT and 4,549,498 to Meyer et al.

Boat operators who prefer to speed through the water usually with maximum acceleration from a "dead in the water" start find it useful to mount a hydrofoil device upon the motor housing anti-cavitation plate to enhance planing efficiency.

That is, the hydrofoil unit tends to keep the stern high and the bow low by providing a "lift" at the stern of the craft.

Examples of typical prior art hydrofoil devices (sometimes referred to as stabilizers) are disclosed and described in U.S. Pat. Nos. 4,445,452 to Loch and 4,487,152 to Larson.

While the above noted prior art devices are operative separately and individually, the prior art references do not show or suggest structure combining a hydrofoil and a trolling plate into a single cooperating system.

That is, none of the prior art arrangements show or suggest a trolling plate in combination with a hydrofoil. In addition, there is no recognition of the benefits of such a combination.

SUMMARY OF THE INVENTION

Consequently, it is a principle object of the present invention to provide an accessory for an outboard and-/or an inboard/outboard motor which takes the form of a combined hydrofoil means and a trolling plate means.

In the following specification and claims the language "outboard motor" is intended to include an "inboard/-outboard motor".

It is a further feature of the invention to provide a fixed hydrofoil means and a movable trolling plate means which in a first or horizontal position enhances and extends the effect of the fixed hydrofoil means.

In effect, the present invention provides a first fixed plate means which operates as a hydrofoil and a second movable plate means which operates dually as a second hydrofoil means and as a trolling plate means depending upon its position relative to the fixed plate means.

The trolling plate means is frequently latched releasably in its trolling position. Therefore, it is a further feature of the present invention to provide automatic release means operable to free the second plate means from the trolling position (vertical position) in the event the boat operator inadvertently "revs" the engine abruptly without first releasing the trolling plate means.

It is a further feature of the present invention to include a shear means in the latch structure which parts and frees the trolling plate means to rotate from its trolling position to its hydrofoil (horizontal) position should inadvertent acceleration occur.

It is a further feature of the invention to provide latch means including a notch and mating pin for retaining said trolling plate in its vertical and horizontal positions. The pin is fabricated of material which will shear and part at its point of entry into the notch so as to release the trolling plate when the plate is stressed, in its vertical position, by rapid acceleration of the boat engine.

It is a further feature of the invention to provide a simple, uncomplicated double plate means structure fabricated of wood, metal or plastic material or a combination thereof.

A combined hydrofoil and trolling means suitable for mounting upon an anti-cavitation plate of a vertical shaft housing of an outboard engine of a water craft embracing certain principles of the present invention may comprise a generally planar first plate means defining a pair of opposed wings or fins connected together in unitary fashion extending in a first direction to operate as a generally horizontal first hydrofoil, a cut-out formed in said first plate means whereby said first plate means is operable to straddle said shaft housing and rest upon said anti-cavitation plate, fastening means on the perimeter of said cut-out for securing the first plate means to the anti-cavitation plate, a generally planar second plate means extending horizontally in a direction opposite to said first direction, said second plate means having a first position defining a second hydrofoil and a second position defining a trolling position, hinge means defining a joint connecting said first and second plate means in an abutting relationship whereby the combined planar surfaces of said first and second plate means, when both are in the horizontal position, present continuous, generally unobstructed top and bottom surfaces, latch means for retaining said second plate means releasably in said horizontal position whereby the hydrofoil effect of said firstplate means is enhanced by the second plate means to create an additional hydrofoil effect, spring means incorporated into said hinge means tending to urge said second plate means from said first position to said second position, and release means for actuating said latch means whereby said second plate means assumes a trolling position in response to said spring means, said latch means being further operable to retain said second plate means releasably in said trolling position.

A method of increasing or enhancing the stern lift of a fixed, generally horizontal hydrofoil of the type which is an accessory to the housing of an outboard boat engine embracing certain other principles of the invention may comprise hinging a trolling plate to the fixed hydrofoil in an abutting relationship, extending the effective area of the fixed hydrofoil by rotating the trolling plate to a horizontal position, fixing said trolling plate releasably in said horizontal position so that the fixed hydrofoil and the horizontal trolling plate present a generally continuous planar surface thereby increasing the stern lift of the craft to which the engine is attached.

Other features and advantages of the present invention will become more apparent from an examination of the succeeding specification when read in conjunction with the appended drawings; in which:

BRIEF DESCRIPTION OF THE DRAWINGS

FIG. 7 is a plan view of an alternative embodiment of the invention;

FIG. 8 is a sectional view of FIG. 7 as viewed in the plane of the line 8—8 and in the direction of the arrows; and FIG. 8A is a detail of FIG. 8, enlarged.

DESCRIPTION OF THE PREFERRED EMBODIMENTS

Figure 1:
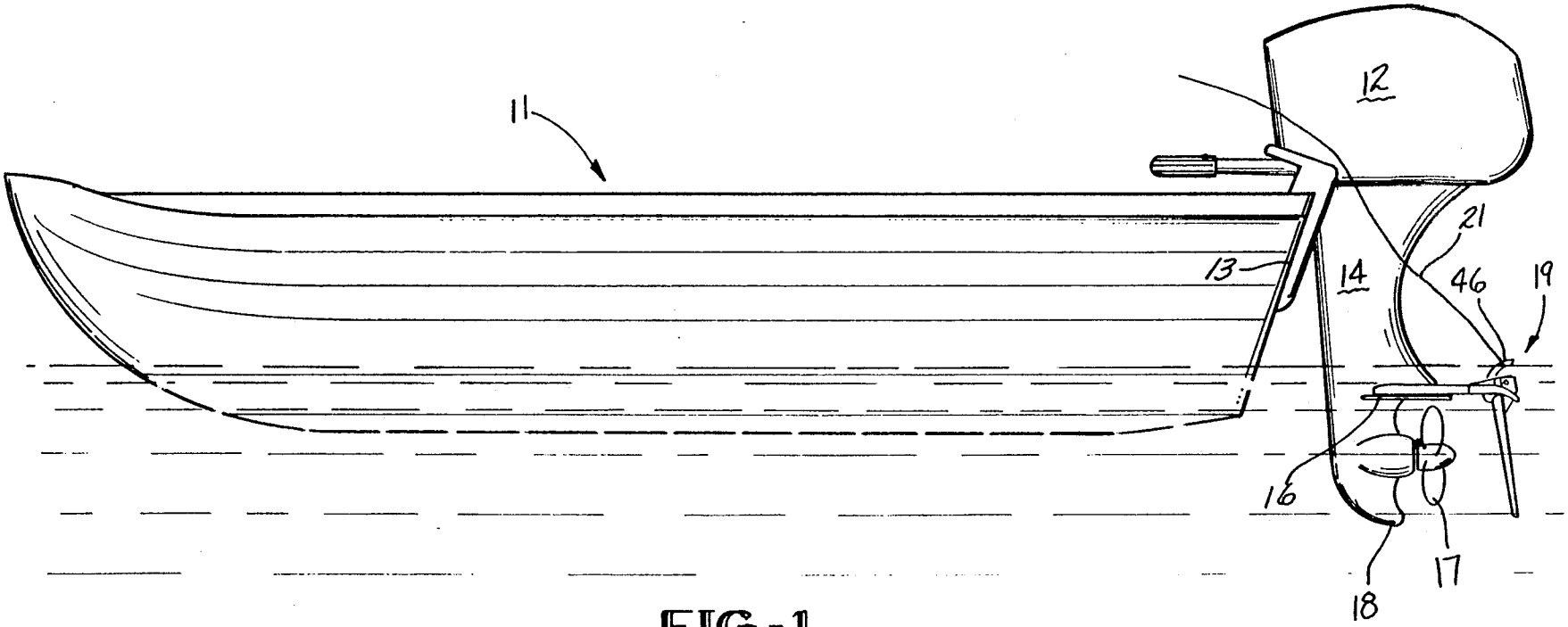
FIG. 1 is a side elevation of a water craft powered by an outboard engine showing the hydrofoil and trolling plate assembly with the trolling plate in the trolling (vertical) position.

Referring in detail to FIGS. 1-6, a boat hull 11 supports an engine 12 suitably attached to the hull transom as at 13. While the disclosed engine is an outboard engine, it is to be understood that the principles of the present invention apply to an inboard/outboard engine as well.

The engine housing 14, enclosing a drive shaft, includes an anti-cavitation plate 16 fixed to the housing, in well-known fashion, disposed above propeller 17; the housing terminates in a strut 18.

Mounted (fixed) to the anti-cavitation plate 16 is a hydrofoil and trolling plate assembly indicated generally by the reference numeral 19. Lanyard 21 connected to latch handle 46 is operable to release the trolling plate for rotation from the generally vertical position of FIG. 1 to a horizontal position.

When lanyard is pulled and motor is accelerated in a forward motion propeller thrust moves trolling plate from its vertical position to the horizontal position automatically.

Figure 2:
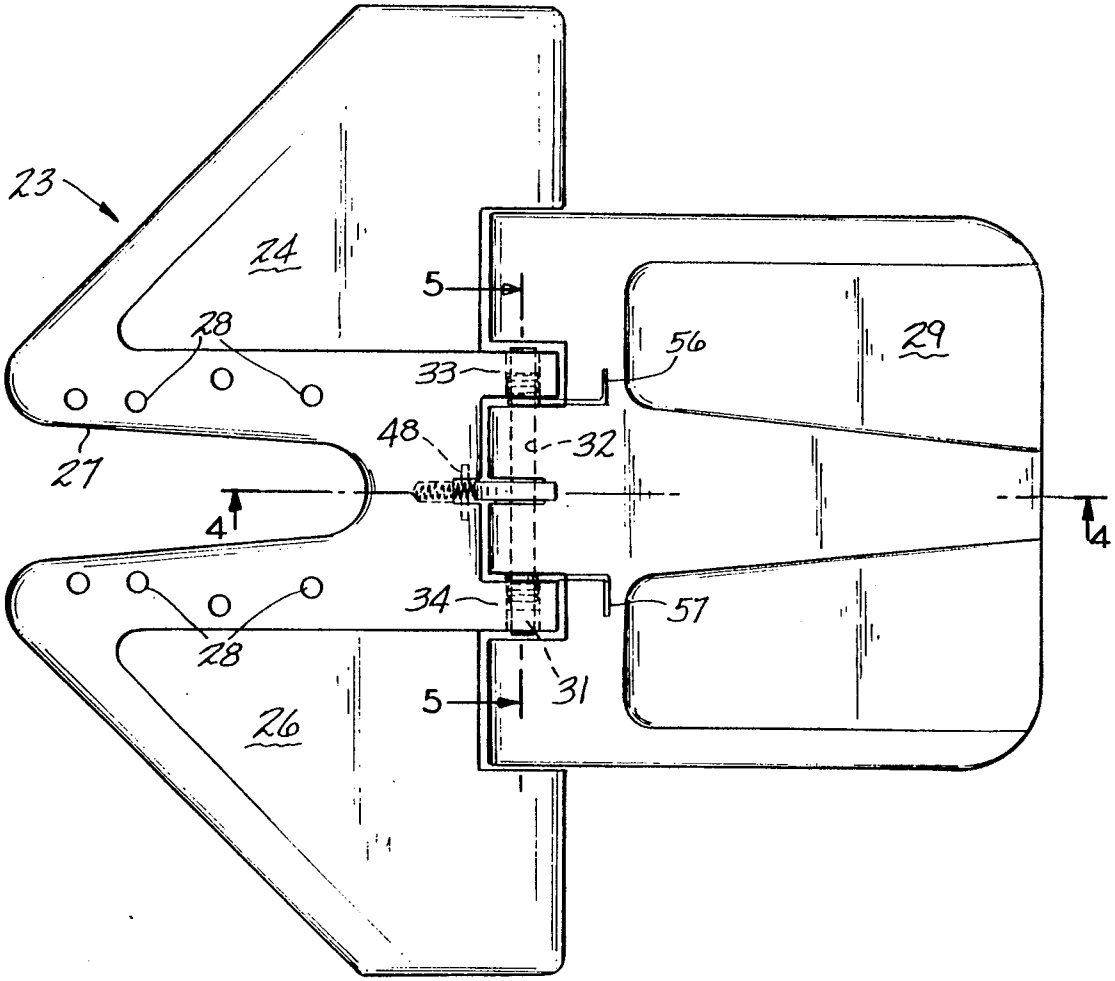
FIG. 2 is a plan view of the preferred assembly wherein the hydrofoil and the trolling plate are both shown in the horizontal position.
Figure 5:
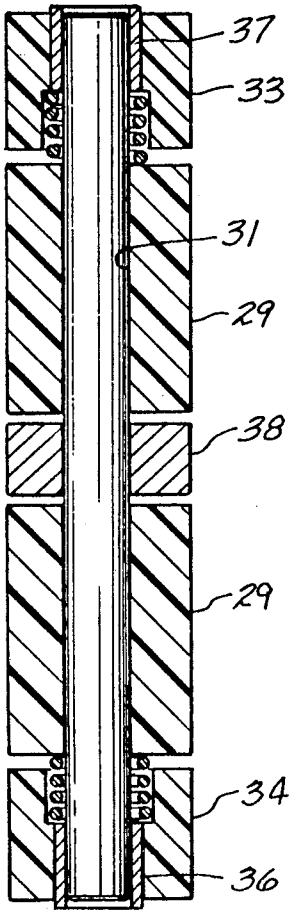
FIG. 5 is a further sectional view of FIG. 2 as viewed in the plane of the line 5—5 and in the direction of the arrows showing the hinge pin, its sleeve bearings or bushings and actuating springs.
Figure 3:
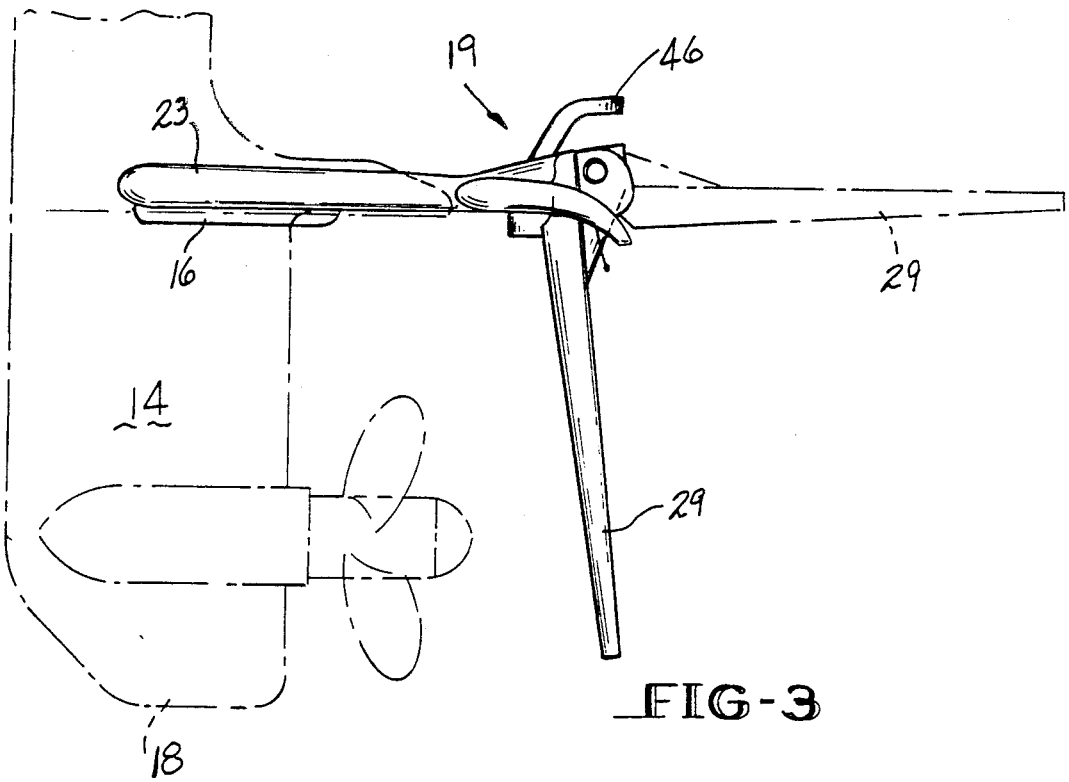
FIG. 3 is a view of a portion of FIG. 1, enlarged for clarity, showing the trolling plate in its vertical and horizontal positions.
Figure 6:
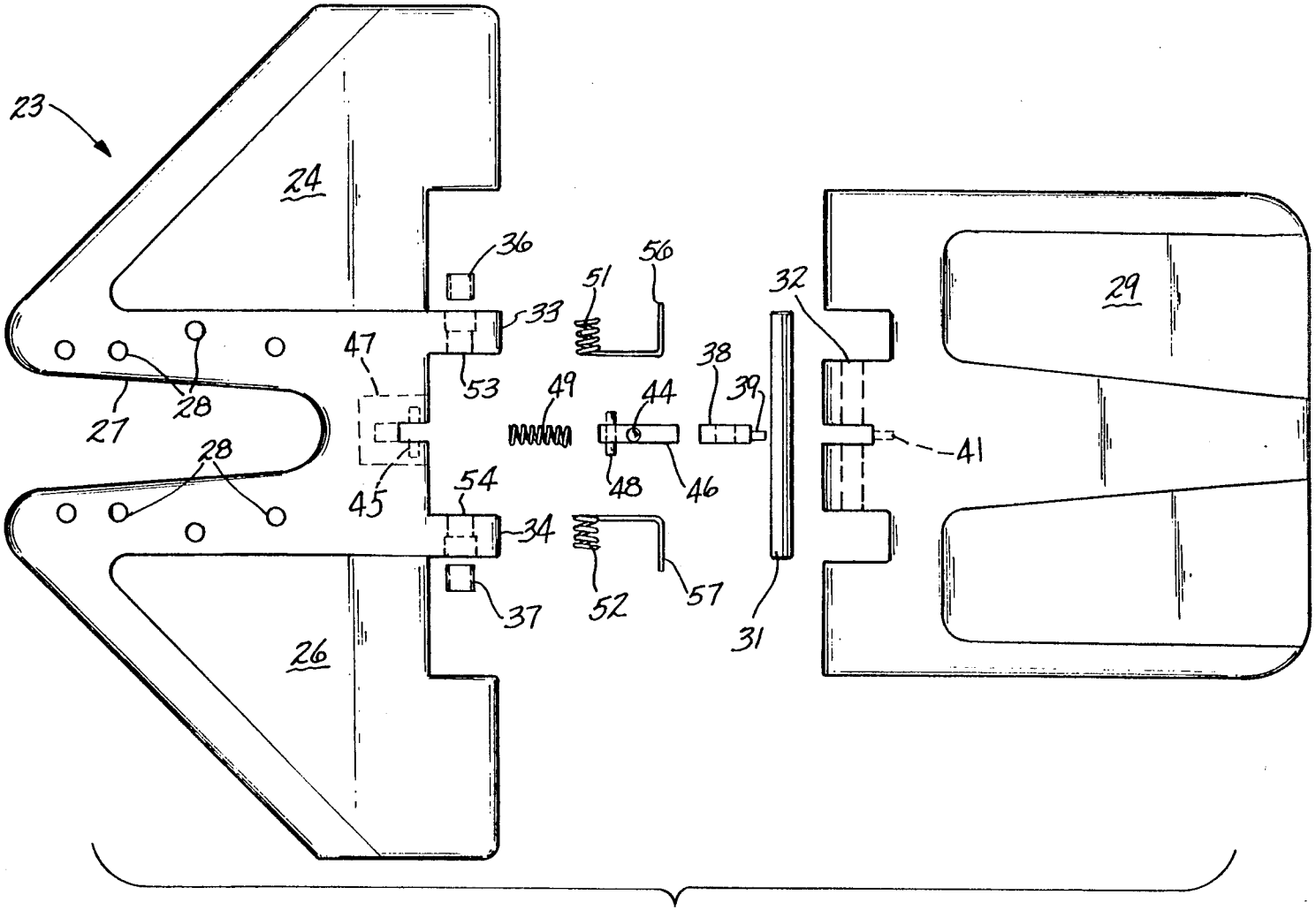
FIG. 6 is an exploded view showing the piece parts of the hydrofoil and trolling plate assembly.

Referring in particular to FIG. 2 and 6, the hydrofoil and trolling plate assembly includes a first generally planar plate means 23 having a pair of opposed wings or fins 24 and 26 connected together in seamless, unitary fashion to define a first hydrofoil.

A cut-out 27 surrounded by mounting holes 28 facilitates bolting (fixing) the first plate means to the anti-cavitation plate 16.

Hinged to and abutting the first plate means 23 is a second generally planar plate means 29 which, in its horizontal position, defines an extension of said first plate means and which, for purposes of claiming the present invention, is termed (when horizontally disposed) a second hydrofoil.

As will be more apparent as the specification proceeds, spring means are provided to urge the second plate means toward its trolling position. Thrust of the propeller, upon engine acceleration, is operable to drive the second plate means, in opposition to the spring means, from the trolling position to the hydrofoil position.

Hinge pin 31 received in through hole 32 is supported in ears 33 and 34 by sleeve bearings or bushings 36 and 37. A notch block 38 is supported by hinge pin 31 and includes a projection 39 received in slot 41 to prevent the block 38 from rotating relative to the hinge pin 31.

Figure 4:
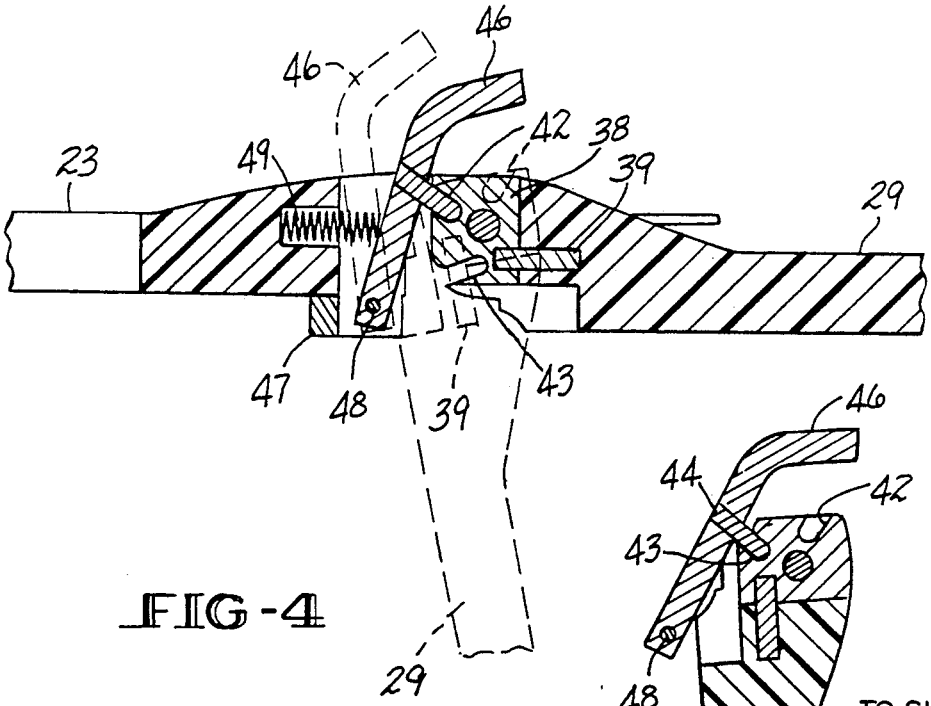
FIG. 4 is a sectional view of FIG. 2 as viewed in the plane of the line 4—4 and in the direction of the arrows.
Figure 4A:
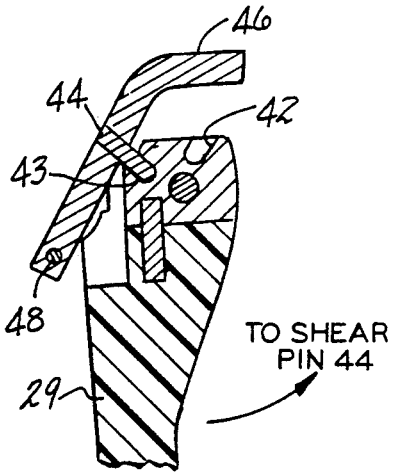
FIG. 4A shows a portion of FIG. 4 illustrating the latch means in the trolling position.

The projection 39 and its slot 41 can be eliminated when the block 38 abuts the plate means 29 snugly, as shown in FIG. 4.

The notch block is formed with two openings or notches 42 and 43 (FIG. 4) for receiving a shear pin 44; one opening 42 corresponding to the horizontal (hydrofoil) position of the second plate means and the other opening 43 corresponding to the vertical (trolling) position of the second plate means.

Operating handle 46, pivotally mounted in block 47 by pin 48 (as indicated further by the reference numeral 45 in FIG. 6) is urged to rotate clockwise, as viewed in FIG. 4, by spring 49 to insure that the shear pin remains latched releasably thereby retaining the second plate means in its first or second position, as desired.

The combination of the operating handle 46, shear pin 44 and the notch block 38 are frequently referred to as latch means.

Coil springs 51 and 52, carried by hinge pin 31, received in counterbore 53 and 54, terminate in fingers 56 and 57, respectively, overlaying second plate means 29 and are tensioned to urge the plate means 29 to the trolling position.

Obviously, the latch operating handle 46 can be operated by grasping the handle directly to rotate the handle counterclockwise in opposition to spring 49 or, if more convenient, the lanyard 21 can be used.

Referring to FIGS. 7, 8, and 8A, an alternative embodiment is disclosed.

The principle differences reside in the latch means, per se, and the method and structure hinging the plate means together.

In lieu of a shear pin, an elongated bar 58, actuated by latch handle 59, is received in elongated slots 61 and 62 to set the respective positions of second plate means 63. The latch handle 59 projects through an opening in the bar 58.

The latch handle 59, received in the bar 58, is mounted pivotally by pin 64 supported by fixed hydrofoil plate 66. The pin mounting is reinforced by right angle clip 67 to prevent the pin from breaking away from the edge of plate 66.

The respective plate means (hydrofoil 66 and trolling plate 63) are hinged by hinge pins 69 and 71, as shown in FIG. 7.

It is to be understood clearly that the present invention provides a double hydrofoil, with greatly enhanced hydrofoil effect, while providing a trolling plate in an assembly which is convenient to operate satisfying both the needs of a sportsman who may wish to troll and the needs of a commercial operator who wishes to proceed at maximum speed.

The second plate means of the present invention when in the horizontal position is operable to change the effective area of a fixed hydrofoil whose area ranges from about 125 to 175 square inches to a new total area ranging from about 270 to 350 square inches, i.e., at least double the surface area.

It has been observed that the double hydrofoil of the present invention increases the hull speed of a water craft appreciably for a given number of revolutions of the propeller compared to single hydrofoil performance.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A combined hydrofoil and trolling plate assembly supported by an anti-cavitation plate positioned on a vertical shaft housing of an outboard motor comprising:

a generally planar first plate means defining a pair of opposed wings or fins connected together in unitary fashion extending in a first direction to operate as a generally horizontal first hydrofoil, a cut-out formed in said first plate means whereby said first plate means is operable to straddle said shaft housing and rest upon said anti-cavitation plate, fastening means on the perimeter of said cut-out for securing the first plate means to the anti-cavitation plate, a generally planar second plate means extending horizontally in a direction opposite to said first direction, said second plate means having a first horizontal position defining a second hydrofoil and a second position defining a trolling position, hinge means defining a joint connecting said first and second plate means in an abutting relationship whereby the combined planar surfaces of said first and second plate means when both are in the horizontal position present continuous, generally unobstructed top and bottom surfaces, latch means for retaining said second plate means releasably in said horizontal position whereby the hydrofoil effect of said first plate means is enhanced by the second plate means to create additional hydrofoil effect, spring means incorporated into said hinge means tending to urge said second plate means from said first position to said second position, and means for actuating said latch means whereby said second plate means assumes a trolling position in response to said spring means, and said latch means being further operable to retain said second plate means releasably in said trolling position.

2. The assembly of claim 1 in which the latch means defines a first latch means pivotally mounted to one of said first and second plate means and a second latch means fixed to the other of said plate means.

3. The assembly of claim 2 in which the first latch means is pivotally mounted to said first plate means and the second latch means is fixed to said second plate means.

4. The assembly of claim 3 in which the first latch means is a pin means and the second latch means is a notch for receiving said pin means.

5. The assembly of claim 4 in which the pin means is a shear pin.

6. The assembly of claim 3 in which the first latch means is an elongated bar and the second latch means is an elongated slot for receiving said bar.

7. The assembly of claim 3 in which the first latch means includes an operating means.

8. The assembly of claim 7 in which the operating means includes a lanyard.

9. The assembly of claim 3 in which the second latch means defines at least two sockets, one socket corresponding to the first position of said second plate means and another socket corresponding to the second position of said second plate means.

10. The assembly of claim 3 in which the second latch means defines a notch block carried by said hinge means, said notch block having at least two notches for receiving said first latch means, one notch corresponding to the first position of said second plate means and a second notch corresponding to the second position of said second plate means.

11. The assembly of claim 10 in which the notch block includes a projection extending into said second plate means to preclude rotation of said notch block relative to said hinge means.

12. A combined hydrofoil and trolling plate assembly suitable for attachment to the housing of an outboard watercraft engine comprising:

a first plate means defining a first hydrofoil, means for connecting said first plate means fixedly to said housing, a second plate means, means for hinging said second plate means to said first plate means, and latch means including a shear pin for retaining said second plate means releasably in a trolling position and for retaining said second plate means releasably in a hydrofoil position whereby said first and second plate means provide a first and a second hydrofoil when said second plate means is in the hydrofoil position.

* * * * *